US006029754A

United States Patent [19]

Kattentidt et al.

[11] Patent Number: 6,029,754

[45] Date of Patent: Feb. 29, 2000

[54] DRILL WITH MOTOR DRIVE AND FEED

[75] Inventors: Hinrich Kattentidt, Darmstadt; Achim Kehrberger, Ostfildern; Winfried Scheid, Ebersbach, all of Germany

[73] Assignee: DELMAG Maschinenfabrik Reinhold Dornfeld GmbH & Co., Germany

[21] Appl. No.: 08/910,240

[22] Filed: Aug. 12, 1997

[30] Foreign Application Priority Data

Aug. 12, 1996 [DE] Germany ..... 196 32 401

[51] Int. Cl.[7] ..... E21B 6/00; E21B 44/00

[52] U.S. Cl. ..... 175/27; 173/6; 173/11

[58] Field of Search ..... 175/27; 173/5, 173/6, 11, 176

[56] References Cited

U.S. PATENT DOCUMENTS

| | | | |
|---|---|---|---|
| 3,593,807 | 7/1971 | Klima | 173/6 |
| 4,354,233 | 10/1982 | Zhukovsky et al. | 364/420 |
| 4,793,421 | 12/1988 | Jasinski | 175/27 |
| 5,131,475 | 7/1992 | Beney | 175/27 |
| 5,449,047 | 9/1995 | Schivley, Jr. | 175/27 |
| 5,458,207 | 10/1995 | Mattero | 175/27 |
| 5,704,436 | 1/1998 | Smith et al. | 175/27 |
| 5,746,278 | 5/1998 | Bischel et al. | 175/24 |

*Primary Examiner*—Hoang Dang

[57] ABSTRACT

A drilling device comprises a drive motor (22), which sets a tool (36) in rotation, and a feed motor (14) which axially displaces the tool. Load sensors (12, 18, 20, 24) detect not only the tool feedrate (V) but also at least two of the three parameters, tool feed force (F), tool torque (M) and tool speed (U). An evaluation and control unit (70) evaluates the above-mentioned parameters and via control units (38, 42) activates the drive motor (22) and the feed motor (14) in such a way that the tool feed force (F) and the tool speed (U) or the tool torque (M) assume values at which the tool feedrate (V) for a specific ground hardness (H) is maximized.

15 Claims, 4 Drawing Sheets

DRILL WITH MOTOR DRIVE AND FEED

BACKGROUND OF THE INVENTION

1. Field of the Invention

The invention relates to a drilling device having a drive motor that sets a tool in rotation, a feed motor that axially displaces the tool and a supply unit that supplies the drive motor and the feed motor with power.

2. Discussion of Relevant Art

From DE 94 02 360 U1 a drilling device is known, which is used to bore holes in a wide variety of types of ground. Associated with the drive motor of said drilling device is a load sensor, the output of which is connected to a control input of a quantity limiter and/or current limiter and/or pressure limiter and/or voltage limiter, which is inserted into a supply line for the feed motor. Overloading of the drive motor is avoided in that at a constant tool speed there is an automatic reduction of the tool feed force upon an increase of the tool torque.

It was then discovered that the fastest possible penetration of the tool into different types of ground is obtained when the tool feed force and the tool speed are each tuned to the ground conditions, i.e. to the hardness of the ground.

SUMMARY OF THE INVENTION

The object of the present invention is therefore to develop a drilling device as described at the beginning of this specification so that an automatic adaptation of the tool feed force and the tool speed or the tool torque to the conditions encountered in the ground is effected in such a way that the feedrate of the tool is maximized.

The object of the invention is achieved by a drilling device that has a drive motor which sets the tool, e.g. a drill, in rotation, having a feed motor which axially displaces the tool, and a supply unit which supplies the drive motor and the feed motor with power. Associated with the drive motor is a load sensor which is connected to a feed control unit for the feed motor.

Disposed between the supply unit and the drive motor is a current controller, by means of which the speed of the drive motor may be influenced.

In addition to the load sensor, further sensors are disposed which, besides the tool feedrate (V), determine at least two variables from the following group: tool feed force (F), tool torque (M) and tool speed (U).

The evaluation and control unit receives output signals of the sensors and activates the feed control unit and the current controller in such a way that the sum of the products of tool speed (U) and tool torque (M), i.e. the tool capacity, and of feedrate (V) and feed force (F), i.e. the feed capacity, substantially corresponds to the maximum total output power of the supply unit, and the tool speed (U) or the tool torque (M) and the tool feed force (F), given any ground hardness (H), are tuned to one another in such a way that the feedrate (V) is maximized.

By virtue of a drilling device according to the invention it is ensured that the total available power is converted in such a way as to achieve in each case a maximum feedrate of the tool. By means of the various sensors, a reliable detection of the actual ground hardness is possible. By varying the tool speed or tool torque and tool feed force, given a specific ground hardness, it is possible to adjust the tool speed and tool feed force values at which the optimum tool feedrate is achieved.

Advantageous developments of the invention are indicated the following features.

The evaluation and control unit is so designed that, for the respective ground hardness (H) of the maximum feedrate (V), it stores in a long-term memory not only the feed force (F) but also at least one of the parameters, tool torque (M) and tool speed (U), which are obtained after maximization of the feedrate (V). This feature offers the possibility of storing the tool feed force and tool speed or tool torque values, which were used during exploratory drilling and earlier work to achieve a maximum tool feedrate, in combination with the ground hardness and use them to quickly achieve a maximum tool feedrate during subsequent drilling operations.

The evaluation and control unit on the basis of the parameters (F,M,U), which are stored for different ground hardnesses (H), and the ground hardnesses (H) generates a characteristic curve KL=KL (H,U,F) and/or KL=KL (H,M, F) and stores it in the long-term memory. According to this feature wherein the evaluation and control unit determines a characteristic curve on the basis of the stored parameters and the respective ground hardness, is particularly advantageous. By said means it is possible to bring about drilling at a maximum feedrate even given hitherto unencountered ground hardness values which are close to stored hardness values.

A characteristic curve ($KL_1$) to ($KL_n$) for each of a plurality of tools and/or a plurality of operating modes 1 to n is generated and filed in the long-term memory. According to this it is possible to store suitable characteristic curves for different tools (e.g. twist drills with different bits, displacer drills, drilling pipe train etc.) and/or different operating modes (drilling, withdrawing, screwing etc.) which specify the parameters with which, given a ground hardness, maximized penetration or withdrawal in terms of speed is achieved.

The evaluation and control unit operates on the fuzzy logic principle. By virtue of this feature use of a control characteristic based on the fuzzy logic principle. By said means, the parameters needed for rapid penetration of the tool are determined particularly quickly.

The feed motor may also retract the tool. This feature makes it possible also quickly to withdraw a tool from underground.

The load sensor comprises a torque sensor. The feed force sensor comprises a force transducer, the load of the drive motor and the tool feed force may be determined particularly easily and reliably.

The drilling device includes at least one extendable and retractable supporting leg which is operated by a supporting motor, the evaluation and control unit effecting an extension of the supporting leg when the feed force sensor detects the generation at the feed motor of a tensile force which exceeds a preset value.

A drilling device thus is provided with an extendable and retractable supporting leg which, when the tool or a drilling pipe, for example, is withdrawn from the bore hole, is automatically extended in order to increase the stability under load of the guide rail.

At least one of the motors is a hydraulic motor. The supply unit comprises an output-controlled hydraulic pump which is driven by a motor. The hydraulic pump is a swash plate reciprocating pump. These developments relate to a drilling device which comprises hydraulic motors and pumps. By said means, a construction which is operationally particularly reliable is guaranteed.

Disposed between drive motor and tool is a change speed gear which is contollable by the evaluation and control unit.

This makes it possible to cover a particularly wide speed range. By said means, optimum drilling capacities may be achieved even with widely differing types of ground.

The change speed gear is a gear which is shiftable under load. This makes it possible because, here, a lowering of the torque is not necessary for changing the speed ratio and so continuous operation of the drilling device is possible.

The change speed gear is an infinitely variable gear. This enables smooth gear shifting and hence reduces the loading of the tool and parts connected thereto.

BRIEF DESCRIPTION OF THE DRAWINGS

There follows a detailed description of an embodiment of the invention with reference to the drawings. The drawings show.

DETAILED DESCRIPTION OF PREFERRED EMBODIMENTS

Figure 1:
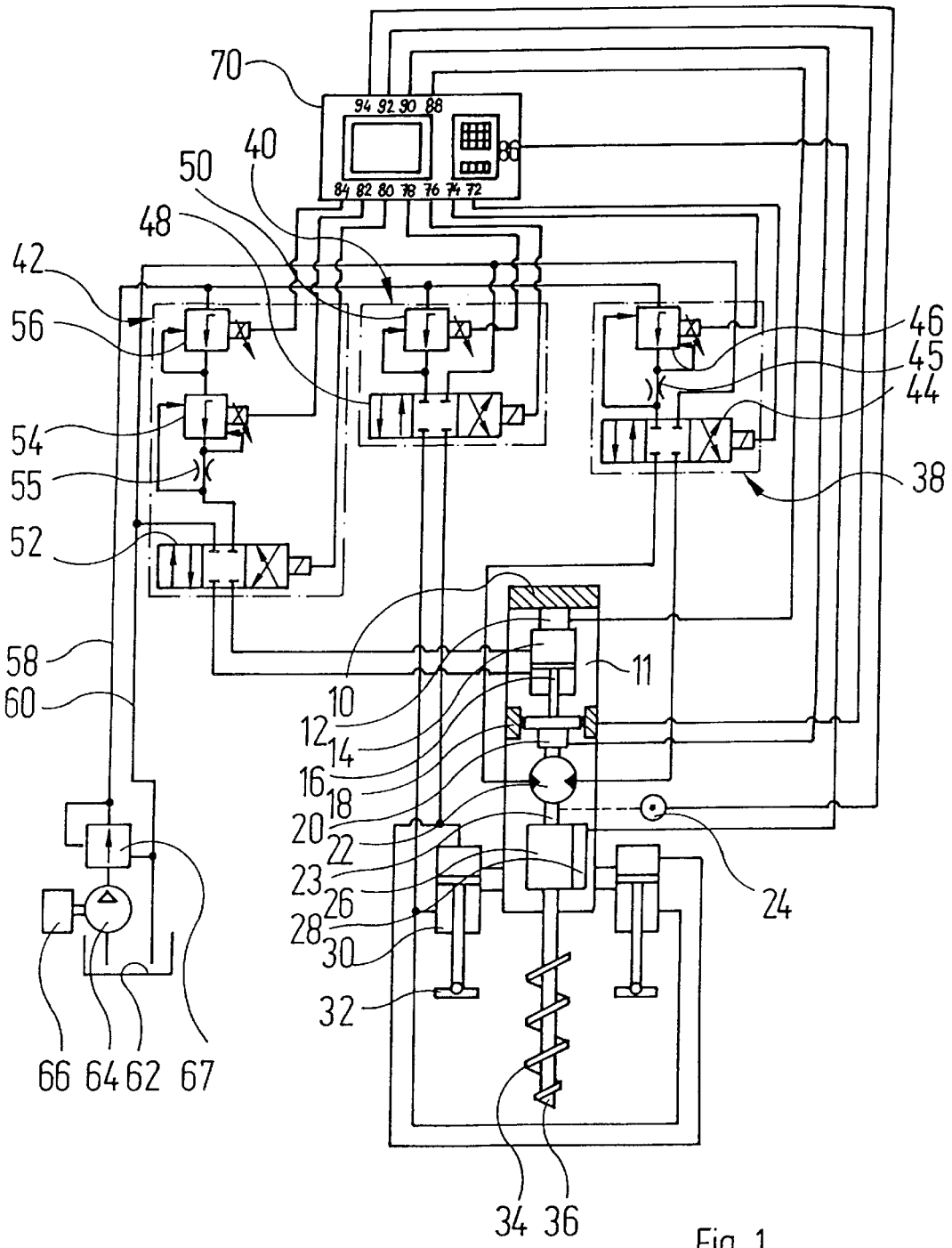
FIG. 1: a diagrammatic view of the most important mechanical and hydraulic components of a drilling device.

FIG. 1 shows a supporting crosshead 10 of a guide rail 11, a force transducer 12 being fastened to the supporting cross-head. Attached to the force transducer 12 is a hydraulic feed cylinder 14, the piston rod 16 of which is connected by a linear bearing, in which a displacement sensor 18 is integrated, to a torque sensor 20. A hydraulic motor 22 is supported in direction of rotation by the torque sensor 20 and, via a connecting shaft 23 cooperating with a speed sensor 24 and via a change speed gear 26 provided with a gear shifting device 28, drives a drill 36 with a helix 34.

Attached to the guide rail 11 are two hydraulic supporting cylinders 30, each of which has a supporting leg 32.

The hydraulic motor 22 is supplied with pressure medium from a drive control unit 38, which comprises a servo control valve 44 and a servo quantity control valve 46 with a measuring throttle 45, at both the input and the output of which a control pressure for the quantity control valve 46 is removed. The drive control unit 38 is connected at the input side to a pressure line 58 and a return line 60.

The hydraulic feed cylinder 14 is connected to a feed control unit 42, which comprises a servo control valve 52, a servo quantity control valve 54 with a measuring throttle 55, at both the input and the output of which a control pressure for the servo quantity control valve 54 is removed, and a servo pressure control valve 56 with downstream actual-value removal. The feed control unit 42 at the input side is likewise connected to the pressure line 58 and the return line 60.

The supporting hydraulic cylinders 30 are supplied with pressure medium by a supporting control unit 40, which comprises a servo control valve 48 and a servo pressure control valve 50 with downstream actual-value removal and at the input side is likewise connected to the pressure line 58 and the return line 60.

Provided in the pressure line 58 is a pressure control valve 67, the relief opening of which is connected to the return line 60.

The pressure in the pressure line 58 is generated by a hydraulic pump 64, which is driven by a diesel engine 66 of a carrier vehicle (not shown) and draws in from a sump 62, into which the return line 60 opens.

FIG. 1 moreover shows an electronic evaluation and control unit 70 which, on the one hand, activates the hydraulic control units 38, 40 and 42 and the gear shifting device 28 and, on the other hand, picks up the values detected by the force transducer 12, the displacement sensor 18, the torque sensor 20 and the speed sensor 24. The electronic evaluation and control unit 70 comprises a computer 71 (cf. FIG. 4) which i.a. determines the feedrate V of the drill 36 from the output signal of the displacement sensor 18. Finally, the evaluation and control unit 70 additionally comprises an interpolator 77 and a differentiator 79 (cf. FIG. 4).

In particular, the components are connected as follows: the force transducer 12 to an input 88; the displacement sensor 18 to an input 92; the torque sensor 20 to an input 90; the speed sensor 24 to an input 94; the gear shifting device 28 to an output 86; the servo control valve 44 for the hydraulic motor 22 to an output 72; the servo quantity control valve 46 for the hydraulic motor 22 to an output 74; the servo control valve 48 for the supporting hydraulic cylinder 30 to an output 76; the servo pressure control valve 50 for the supporting hydraulic cylinder 30 to an output 78; the servo control valve 52 for the hydraulic feed cylinder 14 to an output 80; the servo quantity control valve 54 for the hydraulic feed cylinder 14 to an output 82; the servo pressure control valve 56 for the hydraulic feed cylinder 14 to an output 84.

Figure 2:
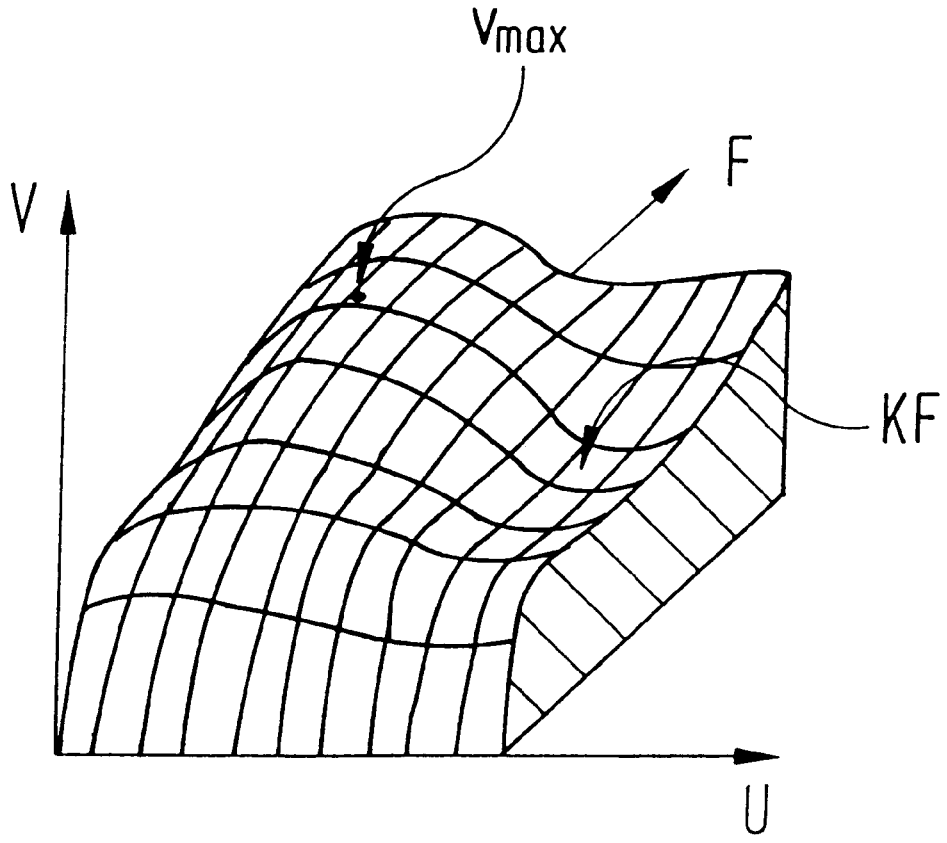
FIG. 2: an exemplary characteristic map, by means of which the three parameters—tool speed, tool feed force and feedrate—are combined.
Figure 3:
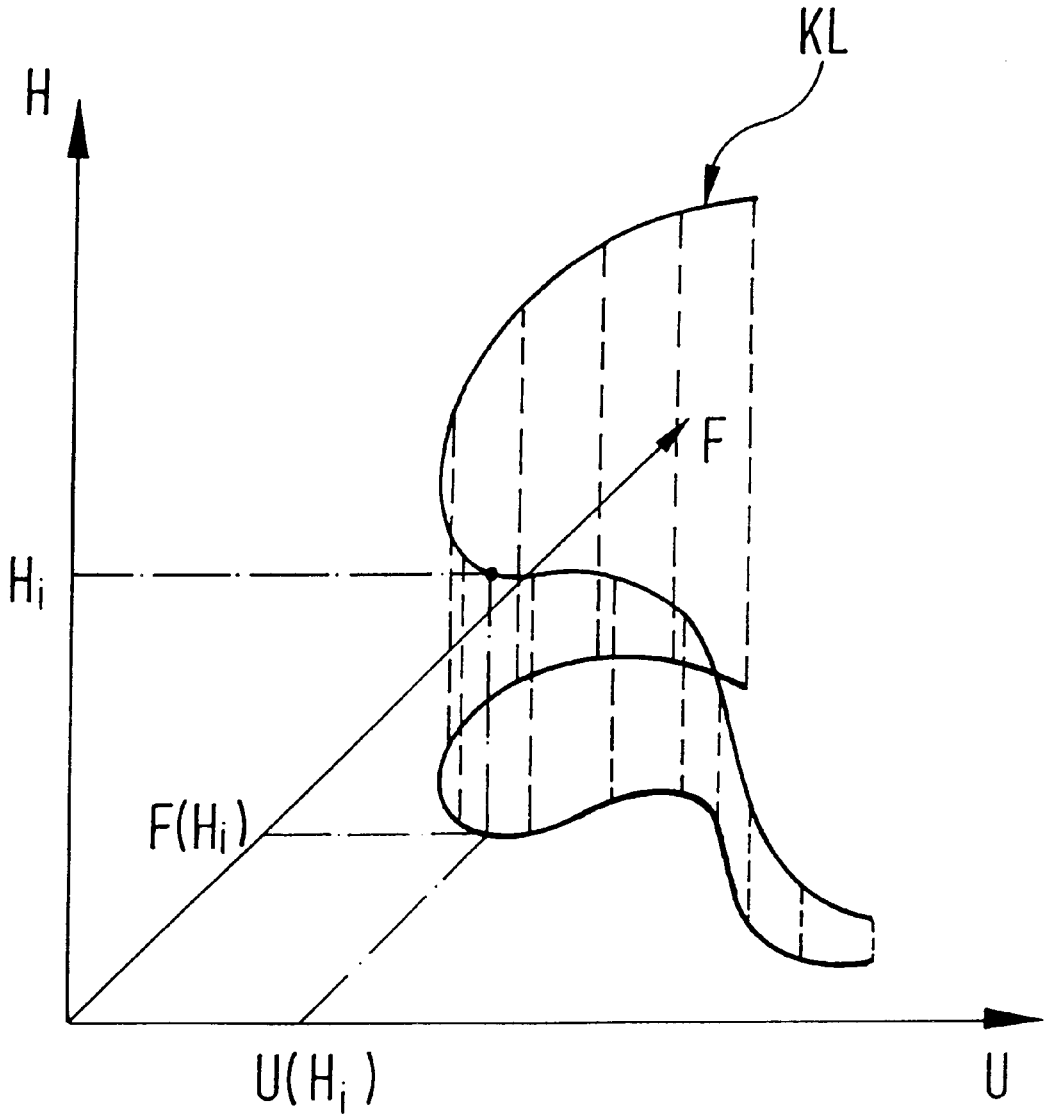
FIG. 3: an exemplary characteristic curve, by means of which the three parameters—tool speed, tool feed force and ground hardness—are combined in each case at maximum feedrate.

The device operates as follows (cf. also FIGS. 2, 3 and 4):

At the start of an initial drilling operation, the drill is set in rotation in that the evaluation and control unit 70 via the output 72 switches the servo control valve 44 into a position in which the drill, viewed from above, rotates in a clockwise direction. At the same time, the evaluation and control unit 70 activates the servo quantity control valve 46 via the output 74 and the change speed gear via the output 86 and the gear shifting device 28 so as to adjust a mean speed U and a mean torque M at the drill 36. The speed at the output of the hydraulic motor 22 is detected by the speed sensor 24 and relayed via the input 94 to the evaluation and control unit 70.

Via the output 80, the servo control valve 52 is activated in such a way that the upper chamber of the hydraulic feed cylinder 14 is under pressure and so the piston 16 with its attached drilling unit is pressed downwards with a mean feed force F and at a mean feedrate V. The force F, with which the hydraulic feed cylinder 14 presses the drill 36 into the ground, is adjusted via the output 84 and the servo pressure control valve 56. Said force is detected by the force transducer 12 and relayed via the input 88 to the evaluation and control unit 70. The feedrate V is limited by the quantity control valve 54 and determined by the displacement sensor 18, the input 92 and the arithmetic circuit in the evaluation and control unit.

Via the output 74, the evaluation and control unit 70 then activates the servo quantity control valve 46 and optionally the gear shifting device 28 in such a way that the drill speed U, for example, initially increases and then decreases. In an identical manner, via the output 84, the evaluation and control unit activates the servo pressure control valve 54 in such a way that the drill feed force F, for example, decreases or increases. This may occur at the same time as and/or after the change of the drill speed. By means of the displacement sensor 18 and the computer 71 the drill feedrate V is determined for each drill speed/drill feed force combination U/F or alternatively for each drill torque/drill feed force combination M/F. The respective combinations V,U,F or V,M,F are filed in a short-term memory 73 (cf. FIG. 4). In the interpolator 77, on the basis of said value triples a characteristic area KF=KF(V,U,F) or KF=KF(V,M,F) for a ground hardness is developed (cf. FIG. 2). With the aid of said characteristic area it is possible to determine by maximum-value generation in the differentiator 79 the value pairs U, F or M, F at which V is a maximum.

The feedrate $V_{max}$ obtained after maximization is, given a constant gross output (i.e. drill capacity+feed capacity), a measure of the hardness H of the ground.

Figure 4:
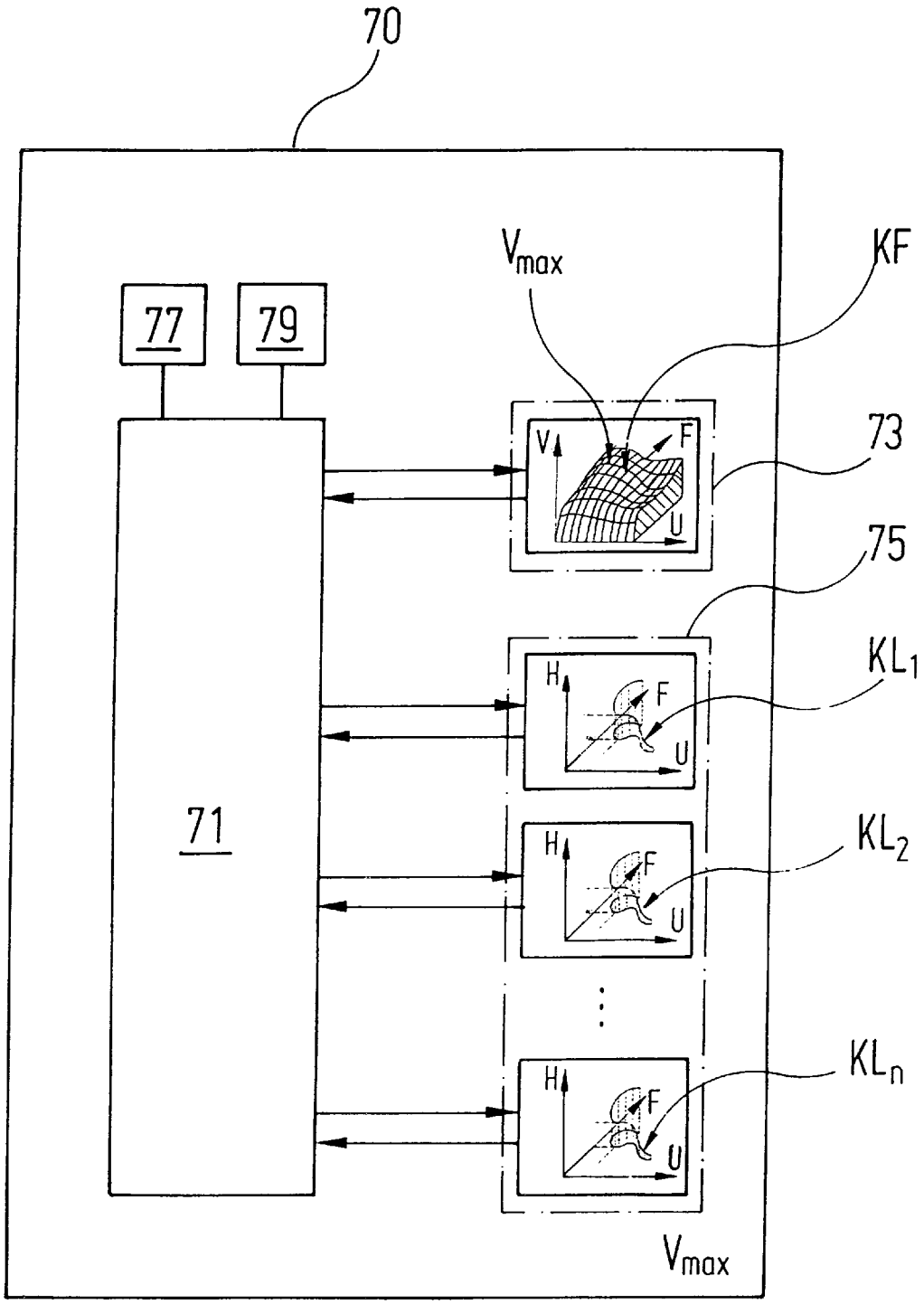
FIG. 4: a diagrammatic view of an evaluation and control unit.

When the evaluation and control unit 70 is a self-learning unit or a fuzzy logic unit with a long-term memory 75 (cf. FIG. 4), it may file in said memory the parameter combinations H,U,F or H,M,F with which the feedrate V is maximized. With time and with the aid of the interpolator 77 it may on the basis of the stored value triples H,U,F and H,M,F develop and store a characteristic curve KL=KL(H, U,F) or KL=KL(H,M,F) for the maximum feedrate $V_{max}$ (cf. FIG. 3). As a result, in the event of recurrent ground hardnesses H it may immediately adjust the parameters in such a way as to achieve the maximum drill feedrate $V_{max}$. The evaluation and control unit 70 may store different characteristic curves $KL_1$ to $KL_n$ for different tools and different operating modes 1 to n (of . FIG. 4).

The evaluation and control unit 70 moreover recognizes from the drill speed U and the drill feedrate V—taking the pitch of the helix 34 also into account—a screw motion of the drill 36, i.e. penetration into the ground without any transport of excavated material. In said case, the drill feedrate V may, if necessary, be limited via the output 82 and the servo quantity control valve 54 in such a way that a screw motion no longer occurs.

For removal of the drill from the ground, the electronic evaluation and control unit 70 via the output 80 switches the servo control valve 52 in such a way that the lower of the two chambers of the hydraulic feed cylinder 14 is under pressure. If the tensile force measured by the force transducer 12 exceeds a value preset in the evaluation and control unit 70, the latter via the output 76 switches the servo control valve 48 into a position in which the upper chambers of the supporting cylinders 30 are under pressure and so the supporting legs 32 are extended. The supporting force of the supporting cylinders 30 may, in said case, be adjusted via the output 78 and the servo pressure control valve 50. Thus, even in the event of high tensile forces a tilting of the guide rail 11 is prevented.

Naturally, instead of the drill 36, a different tool such as a drilling pipe or pile may be fastened to the change speed gear 26 and may be introduced into and withdrawn from the ground by the drilling device in the manner described above for a drill.

We claim:

1. Drilling device having a drive motor (22) which sets a tool (36) in rotation, having a feed motor (14) which axially displaces the tool (36), and having a supply unit (64, 66) which supplies the drive motor (22) and the feed motor (14), there being associated with the drive motor a load sensor (20) which is connected to a feed control unit (42) for the feed motor (14), wherein:

a) disposed between supply unit (64, 66) and drive motor (22) is a current controller (46), by means of which the speed of the drive motor (22) may be influenced, b) in addition to the load sensor (20) further sensors (12, 18, 24) are disposed which, besides the tool feedrate (V), determine at least two variables from the following group: tool feed force (F), tool torque (M) and tool speed (U), c) an evaluation and control unit (70) receives the output signals of the sensors (12, 18, 20, 24) and activates the feed control unit (42) and the current controller (46) in such a way that ca) the sum of the products of tool speed (U) and tool torque (M), and of feedrate (V) and feed force (F), substantially corresponds to the maximum total output power of the supply unit (64, 66), cb) the tool speed (U) or the tool torque (M) and the tool feed force (F), given any ground hardness (H), are tuned to one another in such a way that the feedrate (V) is maximized.

2. Drilling device as claimed in claim 1, wherein the evaluation and control unit (70) is so designed that, for the respective ground hardness (H) or the maximum feedrate (V), it stores in a long-term memory (75) not only the feed force (F) but also at least one of the parameters, tool torque (M) and tool speed (U), which are obtained after maximization of the feedrate (V).

3. Drilling device as claimed in claim 2, wherein the evaluation and control unit (70) on the basis of the parameters (F, M, U), which are stored for different ground hardnesses (H), and the ground hardnesses (H) generates a characteristic curve KL=KL(H,U,F) and/or KL=KL(H,M,F) and stores it in the long-term memory (75).

4. Drilling device as claimed in claim 3, wherein a characteristic curve ($KL_1$) to ($KL_n$) for each of a plurality of tools and/or a plurality of operating modes 1 to n is generated and filed in the long-term memory (75).

5. Drilling device as claimed in claim 1, wherein the evaluation and control unit operates on the fuzzy logic principle.

6. Drilling device as claimed in claim 1, wherein the feed motor (14) may also retract the tool (36).

7. Drilling device as claimed in claim 1, wherein the load sensor (20) comprises a torque sensor.

8. Drilling device as claimed in claim 1, wherein the feed force sensor (12) comprises a force transducer.

9. Drilling device as claimed in claim 1, wherein it comprises at least one extendable and retractable supporting leg (32) which is operated by a supporting motor (30), the evaluation and control unit (70) effecting an extension of the supporting leg (32) when the feed force sensor (12) detects the generation at the feed motor (14) of a tensile force which exceeds a preset value.

10. Drilling device as claimed in claim 1, wherein at least one of the motors (14, 22, 30) is a hydraulic motor.

11. Drilling device as claimed in claim 1, wherein the supply unit comprises an output-controlled hydraulic pump (64) which is driven by a motor (66).

12. Drilling device as claimed in claim 11, wherein the hydraulic pump (64) is a swash plate reciprocating pump.

13. Drilling device as claimed in claim 1, wherein disposed between drive motor (22) and tool (36) is a change speed gear (26) which is controllable by the evaluation and control unit (70).

14. Drilling device as claimed in claim 13, wherein the change speed gear (26) is a gear which is shiftable under load.

15. Drilling device as claimed in claim 13 wherein the change speed gear (26) is an infinitely variable gear.

* * * * *